US008752915B2

(12) United States Patent
Alves

(10) Patent No.: US 8,752,915 B2
(45) Date of Patent: Jun. 17, 2014

(54) ARTICULATION STRUCTURE FOR SLIDING SHELF STEM

(75) Inventor: Gilberto Martins Alves, Curitiba-PR (BR)

(73) Assignee: Electrolux do Brasil SA (BR)

( * ) Notice: Subject to any disclaimer, the term of this patent is extended or adjusted under 35 U.S.C. 154(b) by 0 days.

(21) Appl. No.: 13/037,596

(22) Filed: Mar. 1, 2011

(65) Prior Publication Data

US 2011/0193461 A1 Aug. 11, 2011

Related U.S. Application Data

(63) Continuation of application No. PCT/BR2009/000281, filed on Sep. 1, 2009.

(51) Int. Cl.
*A47B 81/00* (2006.01)
*F24C 15/16* (2006.01)

(52) U.S. Cl.
USPC ..... 312/274; 312/311; 312/410; 126/340

(58) Field of Classification Search
USPC ..... 312/228, 228.1, 410, 311, 269, 273, 312/274, 405; 126/190, 339, 340, 335
See application file for complete search history.

(56) References Cited

U.S. PATENT DOCUMENTS

| | | | | | |
|---|---|---|---|---|---|
| 1,487,950 | A | * | 3/1924 | Kimmerle | 126/340 |
| 1,581,213 | A | * | 4/1926 | David et al. | 126/340 |
| 2,049,237 | A | * | 7/1936 | Wertzheiser | 126/340 |
| 2,095,811 | A | * | 10/1937 | Goulooze | 312/274 |
| 2,263,473 | A | * | 11/1941 | Rogers | 126/340 |
| 2,296,950 | A | * | 9/1942 | Roedl | 312/269 |
| 2,352,613 | A | * | 7/1944 | Bradbury | 126/338 |
| 2,664,878 | A | * | 1/1954 | Durant | 126/41 E |
| 2,987,363 | A | * | 6/1961 | Morse | 312/274 |
| 3,016,276 | A | * | 1/1962 | Morse | 312/274 |
| 3,212,835 | A | * | 10/1965 | Beckett et al. | 312/311 |
| 4,051,838 | A | * | 10/1977 | Pinckney | 126/340 |
| 4,637,373 | A | * | 1/1987 | Shirai et al. | 126/340 |

FOREIGN PATENT DOCUMENTS

| | | | |
|---|---|---|---|
| BR | 8601330-0 | A | 11/1987 |
| DE | 4236740 | A1 | 5/1994 |
| DE | 9413428 | U1 | 10/1994 |
| FR | 1270053 | A | 8/1961 |
| JP | 2004190993 | A | 7/2004 |
| WO | 2004/020910 | A1 | 3/2004 |

OTHER PUBLICATIONS

International Search Report mailed May 7, 2010 for PCT/BR2009/000281.

* cited by examiner

*Primary Examiner* — James O Hansen
(74) *Attorney, Agent, or Firm* — Banner & Witcoff, Ltd.

(57) ABSTRACT

An articulation mechanism for a sliding shelf stem of a household appliance is disclosed. The articulation mechanism may operate without the use of an additional piece and may be made only with a stamping on the counter-door itself of the household appliance. The configuration of the articulation mechanism may simplify its fabrication and assembly, and may reduce or eliminate the need for use of accessories and tools for the assembly processes, simplifying construction.

4 Claims, 6 Drawing Sheets

ARTICULATION STRUCTURE FOR SLIDING SHELF STEM

This application claims priority to Brazilian Patent Application No. MU8801927-6 filed Sep. 1, 2008 and is a continuation of PCT Application Number PCT/BR2009/000281 filed on Sep. 1, 2009, each of which are herein incorporated by reference in their entirety.

FIELD OF THE INVENTION

This invention relates to electromechanical devices including household appliances, Aspects particularly relate to a door with a housing facilitating articulation of a sliding shelf stem in appliances including household stoves.

BACKGROUND OF THE INVENTION

In stoves in use today, it is common to use sliding shelves that coordinate movement along with the opening movement of the oven door. In these products, the shelves are supplied with stems that connect the shelf and the oven door, allowing the shelf traction with the door opening movement.

In order to connect the stems with the door, ear shape add on accessories are manufactured with a fitting for the stem, functioning as a bushing, allowing the rotation of the stem end when this serves to provide traction to the shelf. Such pieces are fastened in the counter-door through adhesive tapes, rivets or screws, requiring the use of an additional operation that requires assembly manpower, which represents an appreciable portion of the product's final price. Eliminating such pieces and, consequently the manpower and assembly processes is desirable.

WO 2004/020910 A1 describes an oven shelf sliding system through rotations added in the stems of the shelves. MU 8601330-0 U describes articulable shelves of pendular oscillatory motion and requires further add-on conventional accessory parts. Neither of these documents contain the innovative features described in the disclosure.

SUMMARY

The present disclosure describes articulation mechanisms including housings in doors for household appliances and related sliding shelf systems. The disclosed articulation mechanisms may include articulation mechanisms for a sliding shelf stem of a household appliance. The articulation mechanism may be formed without the use of an additional piece, and may be made only with a stamping on the household appliance counter-door. Additionally the articulation mechanism may have shapes, dimensions and arrangement that simplify its fabrication and assembly, may reduce or eliminate the need for use of accessories and tools for the assembly processes, consequently simplifying its development.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE DISCLOSURE

Figure 1:
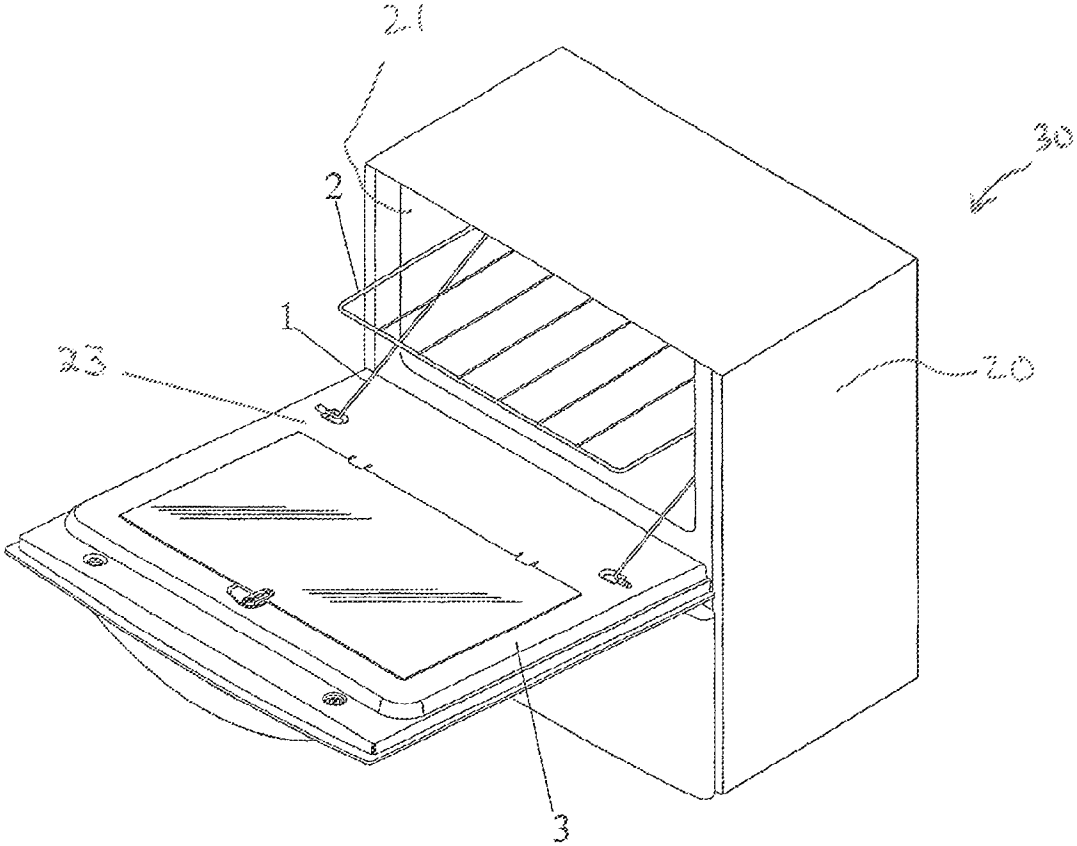
FIG. 1 illustrates a household appliance including a door configured for use with a sliding shelf system.

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

In the present disclosure, the stem articulation structure (1) of the shelf (2) is made by a stamping in a counter-door plate (23) of a door (3) of an appliance such as an oven (30). This stamping provides the counter-door plate (23) of the door (3) a proper container to the stem end (1*a*)of the stem (1) which connects to the door (3), allowing the sliding shelf motion (2) when the counter-door plate (23) and door (3) moves. This stamping operation is made in the tool that shapes the counter-door plate (23) itself, with no need, therefore, for additional manpower, making the assembly cheaper and simple.

Figure 2A:
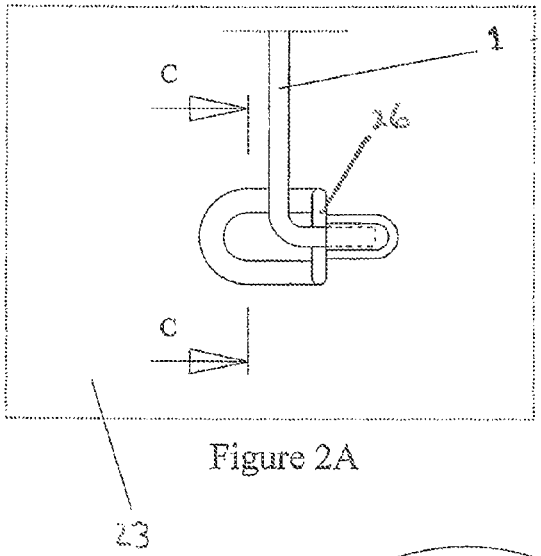
FIGS. 2A-2C illustrates one configuration of a counter-door with a receptacle for use with a sliding shelf system.
Figure 2B:
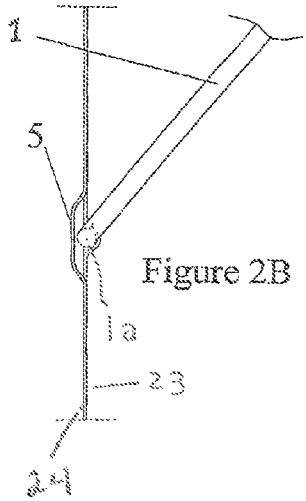
Figure 2C:
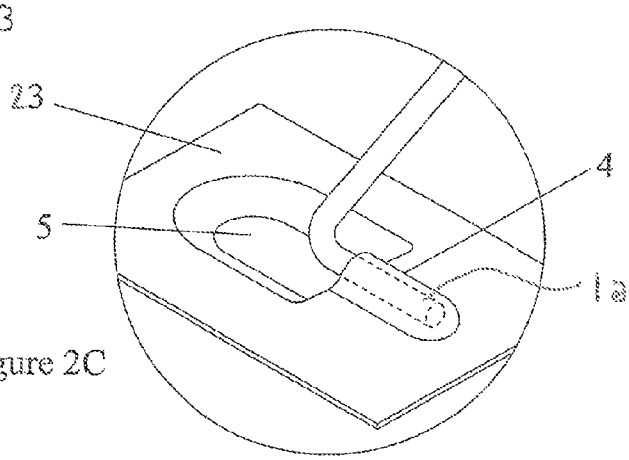

FIG. 1 presents an overview of an appliance, such as a stove or oven (30), having a frame (20) forming a body and having an internal compartment (21). The internal compartment (21) includes a sliding shelf (2) connected to the oven door (3) through a stem (1) which serves as the shelf traction (2) when the oven door (3) opens. As is evident from the figures, the counter door plate (23) defines a primary plane (24) and has a substantially planar surface which faces the interior (21) of the oven (30) when the door (3) is in a closed position. FIG. 2A-2C illustrate a stamping frame arrangement of the stem articulation device (1), comprising of a positive pull (4) on the counter-door plate (23), on the border of a depression (5) in the same counter-door plate (23). FIG. 2A shows a top plan view, FIG. 2B shows a side sectional view taken through line C-C of FIG. 2A and FIG. 2C is a detail perspective view. As shown, the stamping creates a depression (5) in the counter-door plate (23) of the door (3) and, in the border (26) of the depression (5), a positive pull (4) upward the plate plane (i.e., a protrusion), so as to allow the stem end (1*a*)of the stem (1) to enter into the positive pull (4). As can best be seen form FIGS. 2A-2C, the stamping creates an integral recess or depression (5) in the counter door plate (23) in a direction away from the interior (21) of the oven (30) when the door (3) is in a closed position and an integral protrusion (4) in the counter door plate (23) in a direction opposite from the direction of the depression (5), i.e., in the direction toward the interior (21) of the oven (30) when the door (3) is in a closed position. As is further evident from FIGS. 2A-2C, when the stem end (1*a*) is engaged in the protrusion (4), the stem end (1*a*)lies in (i.e., intersects) the primary plane (24) of the counter-door plate (23).

Figure 3A:
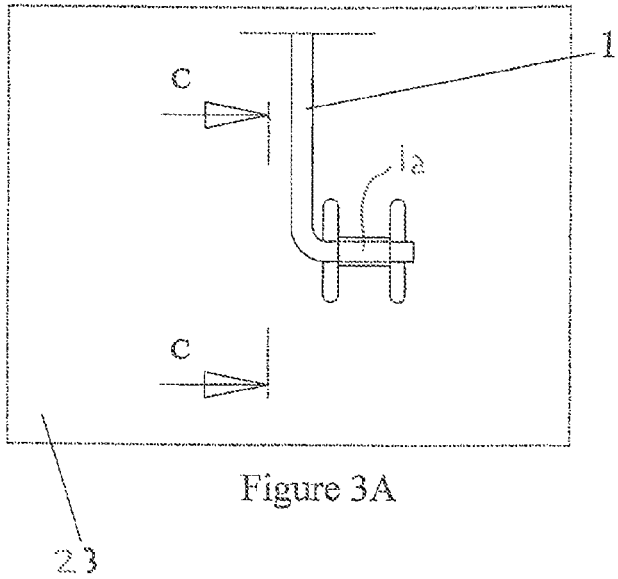
FIGS. 3A-3C illustrates another configuration of a counter-door with a receptacle for use with a sliding shelf system.
Figure 3B:
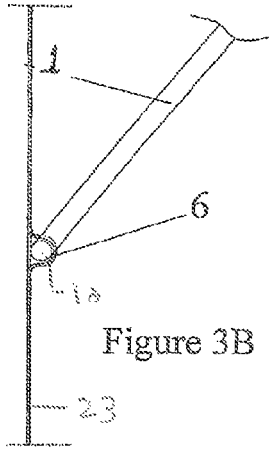
Figure 3C:
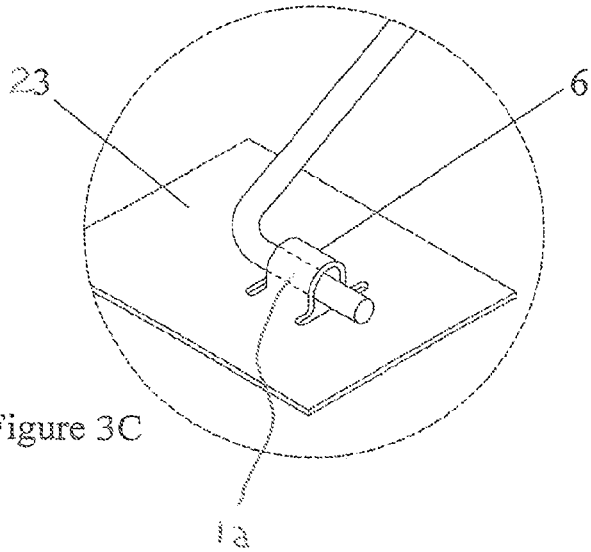

FIGS. 3A-3C present the first stamping frame alternative embodiment of the stem articulation device (1), comprising of a positive pull (6) hollow arch-shape in the counter-door plate (23). FIG. 3A shows a top plan view of the alternative embodiment, FIG. 3B shows a side view and FIG. 3C a detail perspective view. Here, the stamping forms a positive pull (6) in the counter-door plate (23) of the door (3), upward the plate main level, hollow arch-shaped (6), so as to allow the stem end (1) to enter into the hollow arch (6).

Figure 4A:
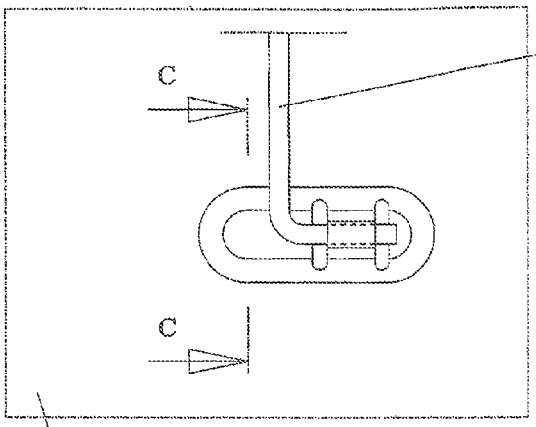
FIGS. 4A-4C illustrates another configuration of a counter-door with a receptacle for use with a sliding shelf system.
Figure 4B:
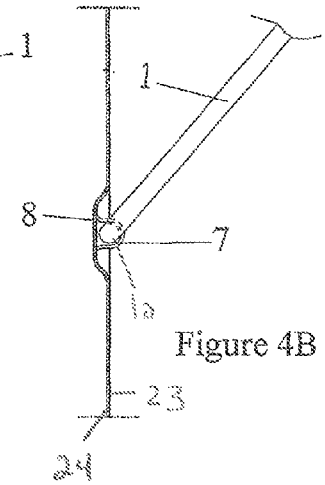
Figure 4C:
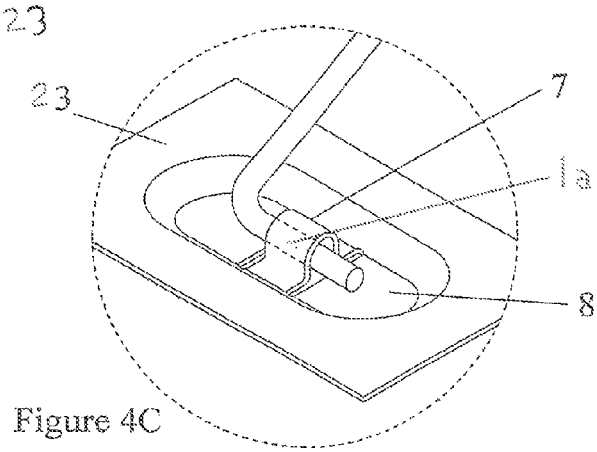

FIGS. 4A-4C illustrates a second stamping frame alternative embodiment of the stem articulation device (1), comprising of a positive pull (7) hollow arch-shape (i.e., protrusion) in the counter-door plate (23), lodged inside a depression (8) on the same counter-door (3). FIG. 4A shows a top plan view, FIG. 4B shows a side view and FIG. 4C a detail perspective view. As shown, the stamping forms a depression (8) in the counter-door plate (23) of the door (3) and, inside the depression (8), a hollow arch (7) upward the plate depression (8) plane, so as to allow the stem end (1) to enter inside the hollow arch (7). As can best be seen from FIGS. 4A-4C, the stamping creates an integral recess or depression (8) in the counter door plate (23) in a direction away from the interior (21) of the oven (30) when the door (3) is in a closed position and an integral protrusion (7) in the depression (8) of the counter door plate (23) in a direction opposite from the direction of the depression (8), i.e., in the direction toward the interior (21) of the oven (30) when the door (3) is in a closed position. As is further evident from FIGS. 2A-2C, when the stem end (1*a*) is engaged in the protrusion (4), the stem end (1*a*) lies in (i.e., intersects) the primary plane (24) of the counter-door plate (23).

Figure 5A:
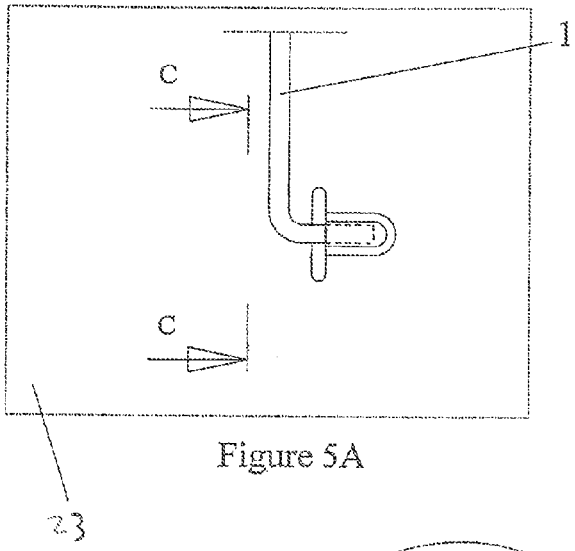
FIGS. 5A-5C illustrates another configuration of a counter-door with a receptacle for use with a sliding shelf system.
Figure 5B:
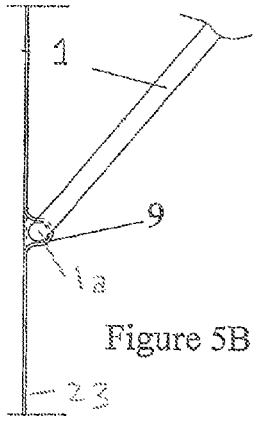
Figure 5C:
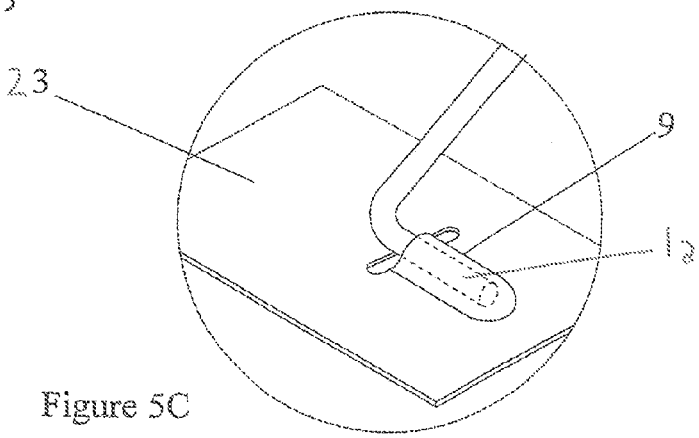

FIGS. 5A-5C show a third stamping framed alternative embodiment of the stem articulation device (1), comprising of a positive pull (9) on the counter-door plate (23). FIG. 5A shows a top plan view, FIG. 5B shows a side view and FIG. 5C shows a detail perspective view. As shown, the stamping forms a positive pull (9) upward the counter-door plate (23) of the door (3) plane level, so as to allow the stem end (1) to enter inside the positive pull (9).

Figure 6A:
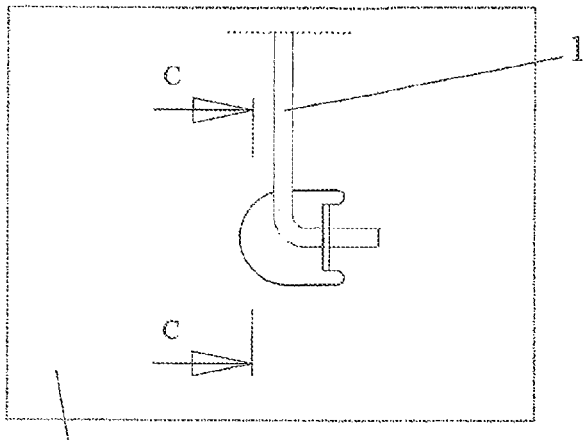
FIGS. 6A-6C illustrates another configuration of a counter-door with a receptacle for use with a sliding shelf system.
Figure 6B:
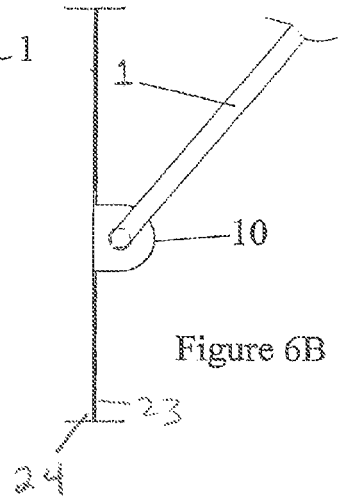
Figure 6C:
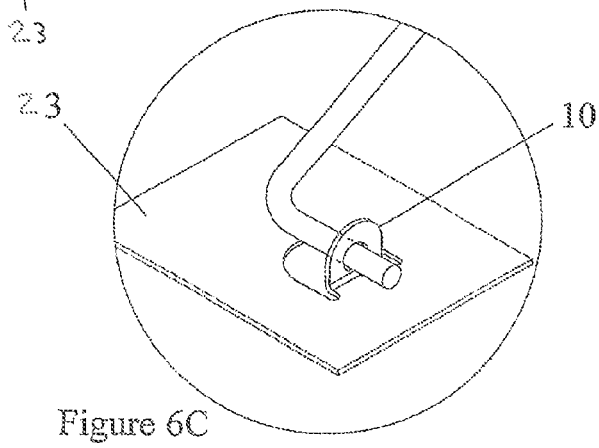

FIGS. 6A-6C illustrate a fourth stamping frame alternative embodiment of the stem articulation device (1) comprising of a vertical tab (10) with a central hole, printed on the counter-door plate (3). FIG. 6A shows a top plan view, FIG. 6B shows a side view and FIG. 6C a detail perspective view. As seen here, the stamping creates a tab perpendicular (10) to the primary plane (24) of the counter-door plate (23), supplied with a central orifice, so as to allow the bar end (1*a*) to enter into the central orifice.

This invention is not limited to the representations mentioned or illustrated herein, and it has to be comprehended in its wide scope. Many changes and other representations of the invention will come in mind of those skilled in the technique to which this invention belongs, having the learning benefit presented in previous descriptions and attached drawings. Further, it is to be understood that the invention is not limited to the disclosed specific shape and that changes and other shapes are understood as enclosed within the scope of the attached claims. Although specific terms are nominated herein, they are only used in a generic and descriptive form and not for a limiting purpose.

The invention claimed is:

1. An appliance door comprising:

a stamped counter-door plate configured to house a stein of a sliding shelf and to facilitate sliding of the sliding shelf through an opening of an appliance, wherein an outer perimeter of the stamped counter-door plate completely surrounds the opening of the appliance when the appliance door is in a closed position, the stamped counter-door plate comprising:

a substantially planar surface which is substantially parallel to a back wall of the appliance when the appliance door is in the closed position, and an integrally formed receptacle comprising:

an integrally formed depression including a perimeter, and an integrally formed arching protrusion disposed at the perimeter of the depression and extending from the planar surffice toward the back wall of the appliance when the appliance door is in the closed position, wherein the integrally formed receptacle is located and configured so as to enable an end of the stem of the sliding shelf to be disengaged and reengaged from the receptacle, wherein an edge of the depression abuts an edge of the protrusion such that the depression facilitates the end of the stem being inserted into the protrusion, and wherein the integrally formed receptacle is further configured to cause the sliding shelf to slide in a direction substantially perpendicular to the back wall of the appliance when the end of the stem is engaged in the receptacle and the appliance door is opened.

2. An appliance comprising:

a frame forming an appliance body and having an internal compartment housing a sliding shelf with a stem; and a door having a stamped counter-door plate configured to house the stem of the sliding shelf and to facilitate sliding of the sliding shelf through an opening of the appliance, wherein an outer perimeter of the stamped counter-door plate completely surrounds the opening of the appliance when the door is in a closed position, the stamped counter-door plate comprising:

a substantially planar surface which is substantially parallel to a back wall of the internal compartment when the door is in the closed position, and an integrally formed receptacle comprising:

an integrally formed depression including a perimeter, and an integrally formed arching protrusion disposed at the perimeter of the depression and extending from the planar surface toward the back wall of the internal compartment when the door is in the closed position, wherein the integrally formed receptacle is located and configured so as to enable an end of the stem of the sliding shelf to he disengaged and reengaged from the receptacle, wherein an edge of the depression abuts an edge of the protrusion such that the depression facilitates the end of the stem being inserted into the protrusion, and wherein the integrally formed receptacle is further configured to cause the sliding shelf to slide in a direction substantially perpendicular to the back wall of the internal compartment when the end of the stem is engaged in the receptacle and the door is opened.

3. An appliance comprising:

a frame forming an appliance body and haying an internal compartment housing a sliding shelf with a stein having a stem end; and a door having a stamped counter-door plate configured to house the stem of the sliding shelf and to facilitate sliding of the sliding shelf through an opening of the appliance, wherein an outer primeter of the stamped counter-door plate completely surrounds the opening of the appliance when the door is in a closed position, the stamped counter-door plate defining a primary plane which is substantially parallel to a back wall of the internal compartment when the door is in the closed position, the stamped counter-door plate comprising:

an integrally formed arching protrusion extending from the primary plane toward the back wail of the internal compartment when the door is in the closed position and shaped to receive the stem end, and an integrally formed depression, wherein an edge of the depression abuts an edge of the protrusion. such that the depression facilitates the stem end being inserted into the protrusion, and wherein when the stem end is positioned in the integrally formed arching protrusion it intersects with the primary plane of the stamped counter-door plate, and causes the sliding shelf to slide in a direction substantially perpendicular to the back wall of the internal compartment when the door is opened.

4. The appliance of claim 3. wherein the integrally formed depression includes a perimeter and the protrusion is located at the perimeter of the depression.

* * * * *